United States Patent [19]

Doby

[11] Patent Number: 4,560,350

[45] Date of Patent: Dec. 24, 1985

[54] END BLOCK

[75] Inventor: Troy Doby, Guilford, N.C.

[73] Assignee: Resco Products, Inc., Norristown, Pa.

[21] Appl. No.: 594,512

[22] Filed: Mar. 29, 1984

[51] Int. Cl.[4] ..... F27D 3/12; E04C 3/10; E04B 5/04

[52] U.S. Cl. ..... 432/241; 52/225; 52/605; 432/137

[58] Field of Search ..... 432/241, 137; 52/227, 52/605

[56] References Cited

U.S. PATENT DOCUMENTS

| | | | |
|---|---|---|---|
| 1,485,109 | 2/1924 | Beth et al. | 432/241 |
| 1,521,216 | 12/1924 | Dressler | 432/241 |
| 1,587,210 | 6/1926 | Beecher et al. | 432/241 |
| 1,824,917 | 9/1931 | Morris | 432/241 |
| 1,893,123 | 1/1933 | Beth | 432/241 |
| 2,075,863 | 4/1937 | Nash | 122/356 |
| 2,839,283 | 6/1958 | Buckholdt | 432/241 |
| 3,035,323 | 5/1962 | Robson | 432/241 |
| 3,759,661 | 9/1973 | Barsby | 432/241 |
| 4,320,612 | 3/1982 | Jeffries, Jr. | 52/396 |

FOREIGN PATENT DOCUMENTS

| | | | |
|---|---|---|---|
| 118628 | 4/1947 | Sweden | 432/241 |
| 2102106 | 1/1983 | United Kingdom | 432/137 |

*Primary Examiner*—John J. Camby

*Attorney, Agent, or Firm*—Seidel, Gonda, Goldhammer & Abbott

[57] ABSTRACT

An end block adapted for use on a kiln car and for retaining a resilient refractory member which bridges between the kiln car and an adjacent kiln car includes a refractory body having a transverse recess. The recess includes an enlarged cavity and a neck portion connecting the enlarged cavity to the end face of the end block adjacent the end of the kiln car. The resilient refractory material bridges between the end blocks on adjacent kiln cars. One end of the resilient refractory material is retained by the recess in one end block and the other end extends into the recess in the end block on the adjacent car or contacts the end face of the end block on the adjacent car. The recess may be off center so that two layers of resilient refractory material may bridge between the two adjacent kiln cars.

24 Claims, 7 Drawing Figures

END BLOCK

BACKGROUND OF THE INVENTION

This invention relates to end blocks adapted to be disposed along the leading and trailing edges of a kiln car. These blocks are sometimes referred to as end seal blocks. Ceramic and/or refractory goods are usually loaded onto kiln cars and transported by the cars through a kiln to be dried and/or fired. The kilns are generally heated from the top or side and some type of insulating barrier is usually maintained to protect the understructure of the kiln cars. At high temperatures, and especially after repeated runs through a kiln, the heat may cause the wheels, axles, bearings and other portions of the truck and frame assemblies of the cars to deteriorate, warp or otherwise become defective. Additionally, the goods which are transported through the kiln should be dried and/or fired in the presence of uniform heat throughout the different zones within the kiln. If cool drafts from the lower regions of the kiln are allowed to reach the goods, they may be adversely affected, such as by incomplete firing or drying, slumping, cracking, etc.

For these reasons, various refractory materials are usually placed on or associated with the kiln car to prevent the transfer of heat from the top of the kiln to the area beneath the load bearing surface of the kiln car and to prevent the transfer of cold air from beneath the kiln car to the area above its load bearing surface. Various shapes of side blocks have been used to prevent heat or cool air from going down or up the sides of the kiln to the area below or above the load bearing surface of the kiln car. These side blocks are generally disposed very close to the walls of the kiln or in overlapping relation with portions of the kiln wall to prevent heat from reaching the underframe of the car and to prevent the cool air from reaching the goods on the car.

End seal blocks have been used on the leading and trailing ends of kiln cars to provide a heat seal between adjacent cars. For example, see U.S. Pat. No. 4,243,385 of Jeffries, Jr., issued Jan. 6, 1981. The Jeffries, Jr. block has a transverse recess at one end face and a transverse projection at the other end face. A row of end blocks are aligned adjacent the end of one kiln car with the end face having the recess exposed and a row of end blocks are aligned adjacent the edge of another kiln car with the projection extending past the edge of the kiln car. To form a seal between the two kiln cars, the two cars are pushed together so that the projections of the one row of end blocks is disposed within the recess in the row of end blocks of the other car. A resilient refractory material is disposed within the recess so that the projection contacts the refractory material.

Nash U.S. Pat. No. 2,075,863 discloses a refractory wall block having a recess into which a projection of an adjacent block is inserted.

The base layer shown in the Beth U.S. Pat. No. 1,893,123 has a recess into which the projection of an adjacent car is inserted to form a narrow passageway between the two adjacent cars. Morris U.S. Pat. No. 1,824,917 and Barsby U.S. Pat. No. 3,759,661 also disclose end blocks or plates which form a stepped passageway between adjacent cars.

None of these patents discloses an end seal block which is adapted to retain a resilient refractory member bridging between the end blocks of two adjacent kiln cars according to the present invention.

SUMMARY OF THE INVENTION

The present invention is directed to an end block adapted for use in a kiln car which will retain a resilient refractory member within a recess so that one end portion of the resilient material bridges the gap between two adjacent kiln cars. The recess is capable of retaining the resilient refractory material without the use of fastening means. The other end of the resilient material contacts the end face of the end block on the second kiln car or may extend into a recess in the end block of the second car.

It is an object of the present invention to provide an end block adapted to retain a resilient refractory material which end block and material effectively prevent or minimize the transfer of heat in a kiln from the region above the end block to the region below the end block, and which effectively prevent or minimize the transfer of cold air from the region below the end block to the region above the end block.

It is another object of the present invention to provide an end block adapted for use on a kiln car which is structurally interrelated in a manner which is simple, inexpensive, and reliable in performing its intended function with minimal damage during use.

A further object of the present invention is to provide apparatus including an end block and resilient refractory material which provide a positive seal between adjacent kiln cars.

A still further object is to provide an end block which requires replacement of only one row of end blocks on an existing kiln car and yet is capable of providing a positive seal between adjacent kiln cars.

An additional object is to provide means for wedging the resilient refractory material in the recess of the end block.

Yet another object is to provide means to protect the resilient refractory material from rubbing of the cars together and slag from solid fuels.

A still further object is to provide a double seal between end blocks of adjacent kiln cars.

Other objects and advantages will appear hereinafter.

The objects of the invention are accomplished by providing a end block with a transverse recess in at least one end face. The recess includes an enlarged cavity and a neck portion connecting the enlarged cavity to the end face.

One end portion of a blanket or sheet of resilient refractory material having a thickness greater than the width of the neck portion of the end block recess is stuffed into and retained by the recess. The opposite end portion of the resilient refractory material extends beyond the surface of the end face and contacts the end face of an end block on an adjacent kiln car.

To wedge the resilient refractory material into the recess, a rod may be inserted into the end portion of the resilient refractory material within the enlarged cavity.

The resilient refractory material may be protected from rubbing of the cars together and slag attack from solid fuels by encasing the material in a ceramic fiber blanket.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION

Figure 1:
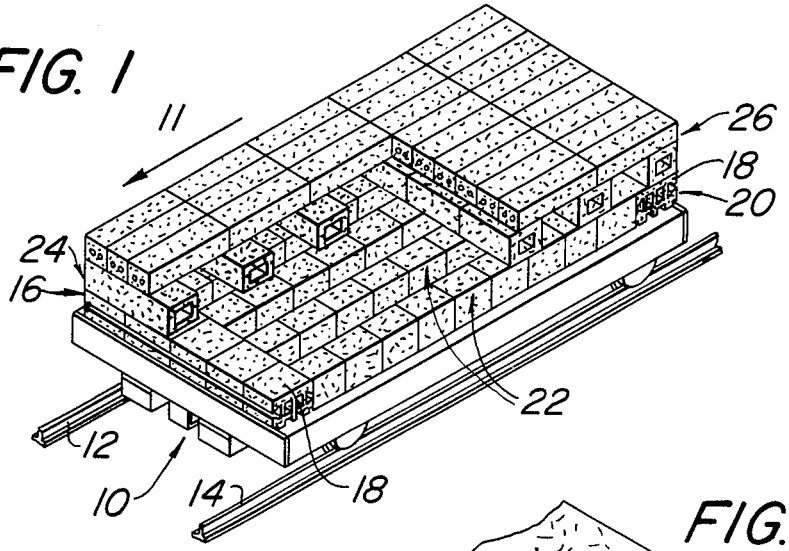
FIG. 1 is a partial perspective view of a kiln car having end blocks according to a preferred embodiment of the present invention disposed on the ends thereof moving on rails through a kiln, the kiln structure not being illustrated.

For uniformity in describing the invention, the left side of the drawing sheets will be considered the front end on the figures. It is to be understood, however, that the end block according to the present invention has no specific "front" or "rear" end.

Referring to the drawings in detail, wherein like numerals indicate like elements, there is shown in FIG. 1 a kiln car designated generally as 10. The kiln car is a substantially flat platform mounted on wheels which ride on tracks 12 and 14. Although either end of the kiln car 10 may be the front end, the front end of car 10 is designated to be the left end of FIG. 1 for purposes of illustration. Thus, the car will move through the kiln in the direction of arrow 11.

The front end of car 10 contains a transverse row 16 of end blocks 18 in accordance with the present invention. The rear end of car 10 is also provided with a transverse row 20 of end blocks 18 in accordance with the present invention. The blocks 18 in each of the rows 16 and 20 are identical and symmetrical. By providing blocks which are identical in configuration, the inventory of blocks having different shapes can be substantially reduced. By being symmetrical, a block may be reversed end for end to expose a new end face if the first end face were cracked or otherwise damaged.

Figure 4:
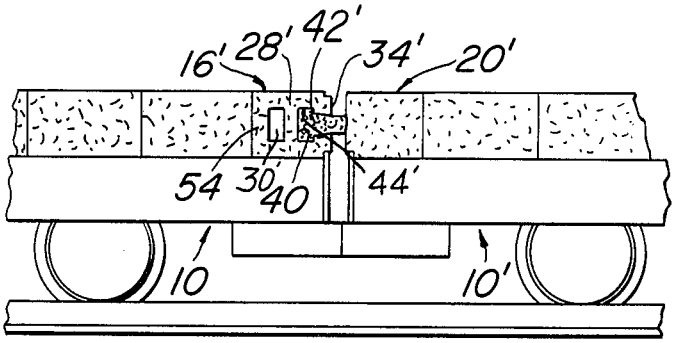
FIG. 4 is a side elevation similar to FIG. 3 showing a second embodiment of the end block of the present invention.

Although presently preferred, it is not essential that the blocks be symmetrical, for example, see the embodiment shown in FIG. 4.

A plurality of rows 22 of spacer blocks extend between the transverse rows 16 and 20. The spacer blocks may be the same height as the end blocks 18. Spaced transverse rows of support blocks 24 are laid across the end blocks and spacer blocks. A layer of deck or spanner tile 26 is laid on the spacer blocks as shown in FIG. 1 to form an underfired kiln car. The ware load of goods to be dried and/or fired are stacked on the layer of deck tile. The flame and hot air are directed from the kiln walls at the level of the support blocks. The through openings in the support blocks and the spaces between the rows of support blocks allow for circulation of heat below the deck tile to uniformly heat the ware load. The blocks may be arranged as known in the art to form a topfired or sidefired kiln car using the end blocks of the present invention to seal the gap between the cars.

Figure 2:
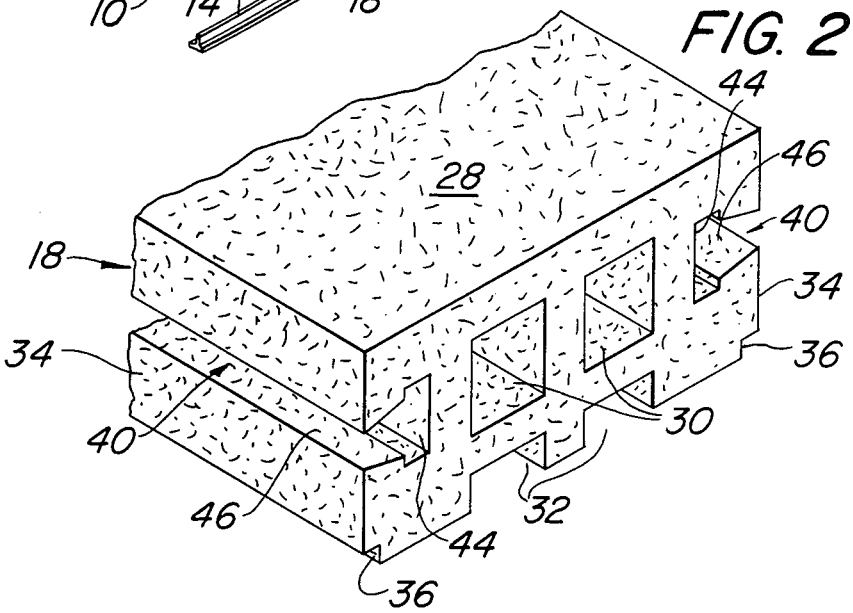
FIG. 2 is a partial perspective view of an end block according to the preferred embodiment of the present invention as used in the kiln car as shown in FIG. 1, but on an enlarged scale.

As shown more clearly in FIG. 2, each of the blocks 18 includes a refractory body 28 which may be solid or hollow. The hollow blocks having through openings 30 are preferred, because they are less expensive to make since less material is used and more efficient since less mass is heated with each trip through the kiln. Preferably, the through openings are transverse and generally parallel to the front and rear faces of the block as shown in FIG. 2. The block may be made even lighter if one or more recesses 32 are located in one or both of the horizontally disposed faces. It is preferred to locate the recesses 32 in only the bottom face since the top face will support a support block 24.

Each of the end faces 34 preferably has a transverse notch 36 at the bottom edge. The notch allows block 18 to be disposed over the end plate 38 of kiln car 10 as shown in FIG. 3.

A recess 40 extends into and transversly across each end face of the block 18. The recess should be shaped so that a layer of resilient refractory material 42 can be retained in the recess preferably by means of the compressible nature of the resilient refractory material and the retaining shape of the recess 40. Thus, recess 40 should be shaped to be adapted to retain material 42 thereon without fasteners, such as adhesives, nails, screws, staples or the like to allow for the easy changing of material 42. Such a shape may be obtained by forming the recess with an enlarged cavity 44 and a neck portion 46. In the embodiment shown in FIG. 2, the enlarged cavity is generally rectangular in shape and the neck portion 46 is a dove tail having the smallest vertical dimension flush with the end face 34. The material 42 is firmly retained in the recess 40 by stuffing one end portion of the material past the neck portion 46 and into the enlarged cavity 44.

The opposite end portion of the resilient refractory material is bridged across the gap between the end blocks of two adjacent kiln cars and extends into the recess of the end block on the adjacent car. If only one row of conventional end blocks is replaced with the end block of the present invention, the opposite end portion of the resilient refractory material will bridge across the gap between the end blocks of the two adjacent kiln cars and contact the flat end face of the adjacent end block in a manner similar to that shown in FIG. 4. Preferably, the resilient refractory material is long enough to be threaded through all the recesses in the one row of end blocks. Such a layer of material seals the gap between the adjacent kiln cars. Any suitable refractory material may be utilized for material 42 so long as it is sufficiently resilient to be stuffed into the recesses and can withstand the temperatures and atmosphere of the kiln in which the kiln car is to travel. For example, suitable ceramic fiber blankets are commercially available from Babcock & Wilcox Company under the trademark "KAOWOOL", from Carborundum Company under the trademark "FIBREFRAX" and from Johns-Manville Products Corporation under the trademark "CERABLANKET". The material 42 is in the form of an alumina-silica blanket which will withstand temperatures up to about 2300° F. Other ceramic fiber blankets are available that can withstand temperatures up to 2600° F.

Figure 3:
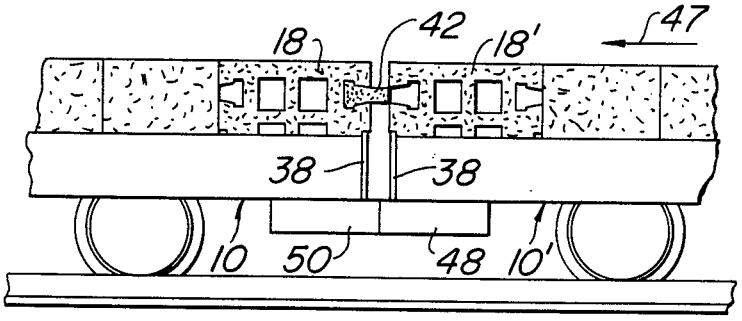
FIG. 3 is a side elevation of the rear end of a leading kiln car and the front end of a trailing kiln car, with end blocks according to the preferred embodiment of the present invention shown in FIG. 2 on the respective cars, a resilient refractory member bridging between the two cars.

In FIG. 3, for the purposes of illustrating the end blocks of the invention in use, there is shown the rear end of car 10 and the front end of car 10'. The cars are travelling in the direction of arrow 47. The cars are of dimension so as to minimize transfer of heat between the cars and the side walls of the kiln in a conventional manner. As the cars 10 and 10' move through the kiln, the front bumper 48 on car 10' is in contact with the rear bumper 50 on car 10. Blocks 18 and 18' are so dimensioned and placed on cars 10 and 10', respectively, to avoid block-block contact. Thus, bumpers 48 and 50 are used to push the cars through the kiln. The notches in the blocks enable the row of end blocks to project over the end plates 38.

The dimensions of blocks 18 may be varied within a substantial range. Typical dimensions follow. Blocks 18 have one preferred height of approximately 5¾ inches but the height may vary between about 4½ and about 12 inches. The width of the blocks is preferably about 11 inches but may vary between about 8 inches and about 15 inches. The length of the blocks depends on the width of the kiln car and the number of blocks desired to be placed on the leading and trailing ends thereof. Typical lengths vary between about 12 and about 18 inches. The enlarged cavity may be about 2 inches by about ¾ of an inch and the neck portion may be about 1¼ inches in length with a maximum vertical dimension of about 1½ inches and narrow to about 1¼ inches at the face of the end block. The through openings may be about 2¼ inches by about 2½ inches and the recesses in the bottom major surface may be about 2⅛ inch by about 1 inch deep with about 1¼ inches between the recesses.

End blocks may be made from any one of a variety of standard refractory materials. The preferred material being andalusite-pyrophyllite ore with fire clay binder in a manner well known to those skilled in the art. The usual method of making the blocks is by extrusion, however, molding or casting or pressing may be a suitable method.

A modified embodiment of the FIG. 2 end block is shown in FIG. 4. The refractory body 28' has only one recess 40. The end face 54 opposite the recessed end face is flat. Therefore, the end block cannot be turned end for end as the FIG. 2 embodiment if the end face 34' having the recess is cracked or otherwise damaged. The recess 40 may be on the horizontal center line as shown in FIG. 4 or offset as shown in FIG. 3.

As shown in FIG. 4, the row of end blocks 16' at the rear end of car 10 has been replaced with end blocks having a refractory body 28' in accordance with the present invention. The row of end blocks 20' at the front end of car 10' are conventional end blocks having a flat end face. The resilient refractory material 42' bridges across the gap between the end blocks and contacts the end face of the conventional end block.

As in the FIG. 2 embodiment, the dimensions of the FIG. 4 end block may be varied within a substantial range. Typical dimensions include a height of about 5 inches and a width of about 6 inches. The dimensions of the recess neck may be similar to the FIG. 2 embodiment and the dimensions of the rectangular enlarged cavity 44' may be about 2½ inches by about 1¼ inches. The through opening 30' may be about 2½ inches by about 1¼ inches.

Figure 5:
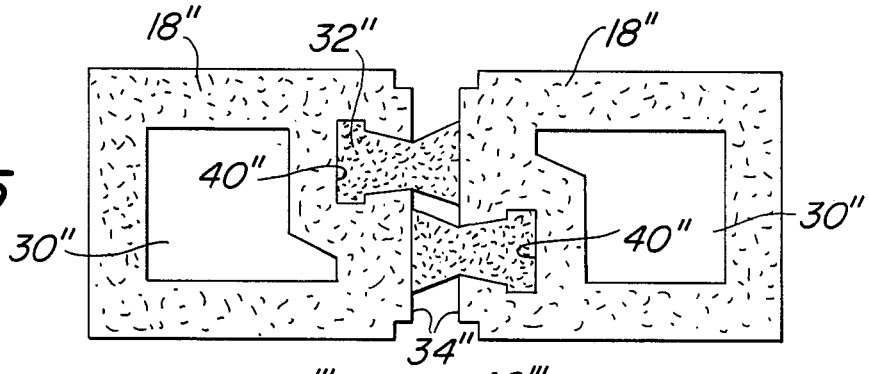
FIG. 5 is a side view of two end blocks of a third embodiment with a double layer of the resilient refractory material bridging the gap between the end blocks.

The recesses 40'' in the FIG. 5 embodiment are substantially off the horizontal center line. By means of such construction, a double layer of resilient refractory material may bridge the gap between the end blocks 18'' as shown in FIG. 5 when the two kiln cars are opposite one another. One end portion of the resilient material 32'' is retained within the recess 40''. The opposite end portion bridges the gap between the end faces 34'' of the end blocks and contacts the flat face of the adjacent end block with the resilient refractory material being compressed between the two end blocks.

If the recess 40'' is approximately the same dimension as the recess shown in the FIG. 4 embodiment, the height of the end blocks may be about 7 inches to provide sufficient front surface area on the end face for contact with the resilient refractory material of the opposing end block.

As with the previous embodiments the length of the block may vary considerably. A typical dimension being about 8½ inches. As shown in FIG. 5, the through openings 30'' need not be rectangular in cross-section. The openings may be substantially rectangular with dimensions of about 3¼ inches by about 4 inches with about a 1¼ inch projection adjacent the major flat surface of the recessed end face.

Figure 6:
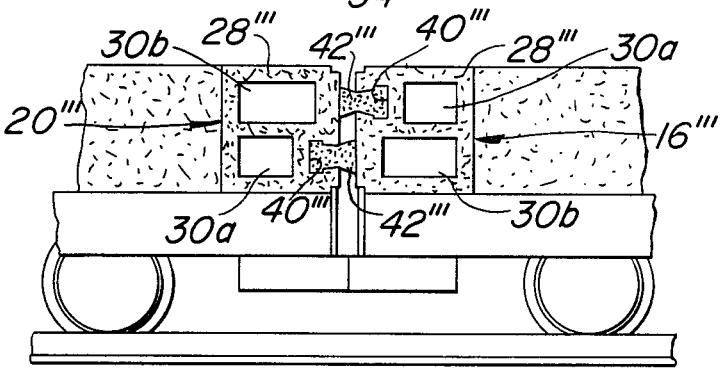
FIG. 6 is a side elevation similar to FIG. 3 showing a fourth embodiment of the end block.

If the height of the end blocks is desired to be at the high end of the range, such as about 11 inches, the end blocks may have two vertically spaced through openings as shown in FIG. 6. The two rectangular through openings **30*a* and 30*b* in the refractory bodies 28''' are vertically aligned. As shown in FIG. 6, the recess 40''' is opposite the smaller through opening 30*a*. Therefore, the resilient refractory material 42'''** is substantially off the horizontal center line.

By placing the rear row of end blocks 20''' on the lead kiln car with the major horizontally disposed face adjacent the recess 40''' on the kiln car and placing the front row 16''' of end blocks on the rear kiln car with the major horizontally disposed face adjacent the recess 40''' upward, two layers of the resilient refractory material 42''' will bridge the gap between the end blocks.

Figure 7:
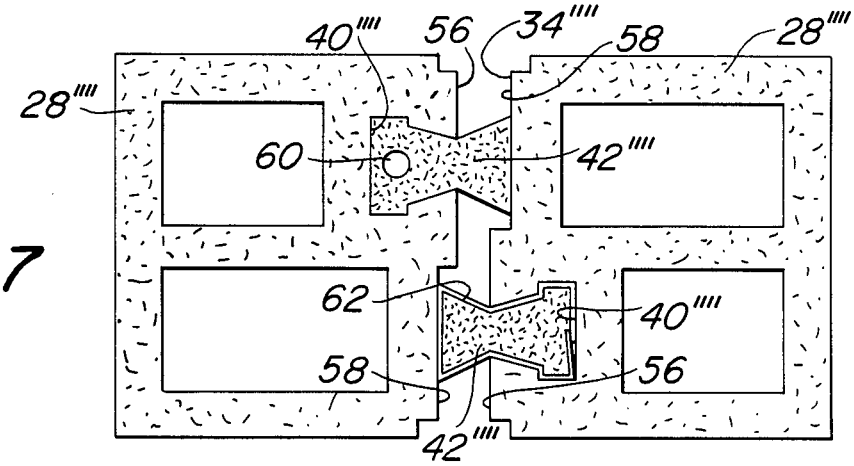
FIG. 7 is a side view of the FIG. 6 end blocks on an enlarged scale but showing modifications in the resilient refractory material

The end blocks shown in FIG. 6 may be modified as shown in FIG. 7. The FIG. 7 refractory bodies 28'''' have a stepped end face 34''''. As shown the projecting step portion 56 of the end face may extend beyond the horizontal center line and include the refractory material retaining recess 40''''. The recessed portion 58 of the stepped end face will contact the opposite end portion of the resilient refractory material 42'''' of the adjacent end block when the kiln cars are pushed together.

Once again the dimensions of the end block may vary over a substantial range. However, typical dimensions may include a height of about 10 inches and a width of about 9 inches with the projection or recess of the step being about ½ inch. The through openings may be about 3 inches by about 4¼ inch and about 3 inches by about 6 inches.

As further shown in FIG. 7, the resilient refractory material 42'''' may be wedged into the recess 40'''' to ensure retention of the material in the recess by inserting a rod 60 through the end portion of the refractory material in the enlarged cavity of the recess. Also, to protect the resilient refractory material from rubbing of the cars together and from slag attack from ignited solid fuels falling on top of the refractory material, the layer of refractory material may be encased in a ceramic fiber blanket or cloth 62 before it is stuffed into the recess 40''''.

The present invention may be embodied in other specific forms without departing from the spirit or essential attributes thereof and, accordingly, reference should be made to the appended claims, rather than to the foregoing specification, as indicating the scope of the invention.

I claim:

1. Apparatus comprising two kiln cars with adjacent ends, a row of end blocks aligned adjacent to said end of each of said cars, and a resilient refractory member retained in a transverse recess in at least one of said blocks on one of said cars and bridging between said kiln cars contacting at least one of said blocks on the other of said kiln cars.

2. Apparatus according to claim 1, wherein each of the end blocks on the one car has an end face with a transverse recess and the resilient refractory material extends through the recesses of the end blocks in the entire row of end blocks on the one car.

3. Apparatus according to claim 1, wherein the resilient refractory member is enclosed in a ceramic fiber cloth.

4. Apparatus according to claim 1, including a rod embedded in the resilient refractory member within the recess of the end block transversely of said end block to wedge the resilient refractory member in the recess.

5. Apparatus according to claim 1 wherein the end block on the one car comprises a refractory body having top and bottom horizontally disposed faces and two vertically disposed end faces, one of said end faces having the transverse recess, the recess including an enlarged cavity and a neck portion connecting a enlarged cavity to said one end face, the vertical dimension of the neck portion being less than the greatest vertical dimension of the cavity, one end portion of the resilient refractory member being retained in the recess, the opposite end portion of the resilient refractory member extending outward from the recess beyond the surface of the one end face and contacting the end block on the other car.

6. Apparatus according to claim 5, wherein the neck portion is offset from the horizontal center line so that the recess at the one face does not lie on the horizontal center line.

7. Apparatus according to claim 6, wherein the one end face is stepped forming two stepped end portions and the recess is in one of the stepped end portions of the stepped end face.

8. Apparatus according to claim 5, wherein the end block on the other kiln car opposite the end block on the one kiln car comprises a refractory body having top and bottom horizontally disposed faces and two vertically disposed end faces, the end face adjacent the end block on the one car having a transverse recess, the recess including an enlarged cavity and a neck portion connecting the enlarged cavity to said end face, a vertical dimension of the neck portion being less than the greatest vertical dimension of the gravity.

9. Apparatus according to claim 8, wherein the opposite end portion of the resilient refractory member extending outward from the recess in the end block on the one car extends into the recess in the end block on the other car.

10. Apparatus according to claim 8, wherein the neck portion of the end block on the one car is above the horizontal center line and the neck portion of the end block on the other car is below the horizontal center line, the opposite end portion of the resilient refractory member extending outward from the recess in the end block on the one car contacting the end block on the other car above the horizontal center line and one end portion of a second resilient refractory member being retained in the recess in the end block on the other car with the opposite end portion of the second resilient refractory member extending outward from the recess and contacting the end block on the one car below the horizontal center line.

11. Apparatus according to claim 5, wherein both of the end faces of the end block on the one car have a transverse recess, each recess including an enlarged cavity and a neck portion connecting the enlarged cavity to a end face, the vertical dimension of the neck portion being less than the greatest vertical dimension of the cavity.

12. Apparatus according to claim 10, wherein the one end face of the end block on the one car and the end face of the end block on the other car adjacent the one end block on the one car are each stepped forming two stepped end portions, the recess in each end block being in the projecting portion of the stepped end face, the opposite end portion of each resilient refractory member extending outward from its respective recess and contacting the end block on the other car at the recessed portion of the stepped end face.

13. An end block designed for use on a kiln car comprising a refractory body having top and bottom horizontally disposed faces and two vertically disposed end faces, one of said end faces having a transverse recess, the recess including an enlarged cavity and a neck portion connecting the enlarged cavity to said one end face, a vertical dimension of the neck portion being less than the greatest vertical dimension of the cavity, the neck portion being offset from the horizontal center line so that the recess at said one face does not lie on the horizontal center line.

14. The end block in accordance with claim 13, and a resilient refractory member having one end portion retained in the recess and one end portion extending outward from the recess beyond the surface of the one end face.

15. The end block in accordance with claim 14, wherein the resilient refractory member is enclosed in a ceramic fiber cloth.

16. The end block in accordance with claim 14, including a rod embedded in the resilient refractory member within the recess transversely of the end block to wedge the resilient refractory member in the recess.

17. The end block in accordance with claim 14, wherein the resilient refractory material is a ceramic fiber blanket.

18. The end block in accordance with claim 13, wherein the one end face is stepped.

19. The end block in accordance with claim 18, wherein the recess is in the projecting portion of the stepped end face.

20. The end block in accordance with claim 13, wherein the end block is provided with at least one opening therethrough extending in a direction generally parallel to the end faces of the end block.

21. The end block in accordance with claim 13, wherein the block is made of refractory material comprising andalusite-pyrophyllite ore with a fire clay binder.

22. An end block designed for use on a kiln car comprising a refractory body having top and bottom horizontally disposed faces and two vertically disposed end faces, each of said end faces having a transverse recess, each recess including an enlarged cavity and a neck portion connecting the enlarged cavity to one of said end faces, a vertical dimension of the neck portion being less than the greatest vertical dimension of the cavity.

23. An end block in accordance with claim 22, wherein one of the horizontally disposed faces has at least one transverse recess.

24. An end block in accordance with claim 22, wherein the body has a notch in at least one edge of the intersection of the horizontally disposed faces and the end faces.

* * * * *